US006846052B2

(12) United States Patent
Kelley et al.

(10) Patent No.: US 6,846,052 B2
(45) Date of Patent: Jan. 25, 2005

(54) DESK WITH CONCEALED KEYBOARD WELL

(75) Inventors: James O. Kelley, Spring Lake, MI (US); Ralph J Byma, Zeeland, MI (US); Gregg J. Persons, Wyoming, MI (US)

(73) Assignee: Sligh Furniture Company, Holland, MI (US)

( * ) Notice: Subject to any disclaimer, the term of this patent is extended or adjusted under 35 U.S.C. 154(b) by 0 days.

(21) Appl. No.: 10/117,430

(22) Filed: Apr. 5, 2002

(65) Prior Publication Data

US 2003/0001464 A1 Jan. 2, 2003

Related U.S. Application Data

(60) Provisional application No. 60/281,660, filed on Apr. 5, 2001.

(51) Int. Cl.[7] ..... A47B 81/00

(52) U.S. Cl. ..... 312/208.1; 312/238; 312/223.3; 108/93

(58) Field of Search ..... 312/223.3, 208.1, 312/238, 107; 108/92, 93, 90, 95, 96, 71, 72, 73, 75, 76, 84, 86, 138

(56) References Cited

U.S. PATENT DOCUMENTS

| | | | | |
|---|---|---|---|---|
| 594,505 A | * | 11/1897 | Welsch et al. | 108/96 |
| 670,370 A | | 3/1901 | Dewhurst | |
| 756,883 A | | 4/1904 | O'Keefe | |
| 820,272 A | * | 5/1906 | Vaaler | 312/25 |
| 993,588 A | | 5/1911 | Donning | |
| 2,240,551 A | * | 5/1941 | Cooper | 108/86 |
| 3,516,369 A | * | 6/1970 | Bidak et al. | 108/138 |
| 3,859,932 A | * | 1/1975 | Armstrong et al. | 108/75 |
| 4,145,097 A | | 3/1979 | Naess et al. | |
| 4,316,082 A | | 2/1982 | Fritz | |
| 4,625,657 A | | 12/1986 | Little et al. | |
| 4,735,466 A | | 4/1988 | Wolters et al. | |
| 4,828,342 A | * | 5/1989 | Stefan | 312/223.3 |
| 5,680,820 A | * | 10/1997 | Randolph | 108/25 |
| 5,772,292 A | | 6/1998 | Touzani et al. | |

FOREIGN PATENT DOCUMENTS

| | | |
|---|---|---|
| DE | 346136 | * 12/1921 |
| DE | 380845 | * 9/1923 |
| DE | 661978 | * 7/1938 |
| DE | 872393 | * 3/1953 |

* cited by examiner

*Primary Examiner*—Lanna Mai
*Assistant Examiner*—Hanh V. Tran
(74) *Attorney, Agent, or Firm*—John A. Waters; Varnum Riddering Schmdt & Howlett, LLP

(57) ABSTRACT

A desk unit incorporating a concealed pull-out keyboard well includes a work surface and a concealed keyboard platform mounted under a work surface. The work surface can have an apron on the lower front surface that conceals the keyboard platform. A movable section of the work surface at a front edge thereof is movable in a path that extends downwardly and under the front edge of the keyboard tray and then rearwardly under the keyboard tray, where the movable section can be stored or removed from the desk unit. When the movable section is thus positioned, the keyboard can be used or extended for use. This desk construction can be employed in a corner mounted desk, wherein the keyboard tray is mounted at an angle under a corner in the desk, or the invention can be employed in a conventional desk having a work surface with a straight front edge.

8 Claims, 11 Drawing Sheets

10
14
14
14

DESK WITH CONCEALED KEYBOARD WELL

CROSS-REFERENCES TO RELATED APPLICATIONS

This is a non-provisional application based on and claiming the filing priority of provisional patent application Ser. No. 60/281,660, filed Apr. 5, 2001, now abandoned, which is incorporated by reference.

STATEMENT REGARDING FEDERALLY SPONSORED RESEARCH OR DEVELOPMENT

Not Applicable.

BACKGROUND OF THE INVENTION

The present invention relates to a desk or work surface wherein a computer keyboard platform is mounted under a front edge of the work surface and wherein a movable section of the front edge of the work surface is mounted on a track that permits the movable section to be moved downwardly and under the keyboard platform for storage or removal.

The use of a computer on a work surface presents some challenges. If a keyboard is simply rested on the top of a work surface, the work surface cannot be used as a writing surface. Also, proper keyboard elevation generally is somewhat lower than the preferred elevation of a writing surface.

In order to overcome these problems, there are numerous keyboard trays that are mounted on or below a work surface, wherein the keyboard tray can be extended outwardly to a use position, generally in front of the front edge of the work surface. Exemplary patents that disclose this type of a construction are U.S. Pat. Nos. 4,316,082, 4,145,097, 4,625,657, 5,653,413, and 5,772,292. Products of this nature usually place the keyboard in front of the desk surface when in its working position, thus placing the user somewhat further from the desk surface in order to use the keyboard. In most applications, the desks are provided with an open recess below the work surface so that the keyboard tray can slide directly outwardly from a recess under the front edge of the work surface. When the work surface has an apron or flange mounted on the underside of the front edge of the work surface, the construction necessary to have a pull-out keyboard tray mounted underneath and behind the apron is more complex, as shown in U.S. Pat. No. 5,653,413.

Another approach to keyboard storage is shown in U.S. Pat. No. 4,735,466, wherein a keyboard is positioned on a pop-up tray that elevates through an opening in the desk work surface when a cover panel is removed and slid rearwardly on the top of the desk surface.

An object of the present invention is to provide an improved keyboard storage mechanism for a desk unit that is useful for both a conventional desk unit and for a corner desk.

BRIEF SUMMARY OF THE INVENTION

In accordance with the present invention, a desk unit incorporating a concealed pull-out keyboard well comprises a work surface having an upper writing surface and a keyboard platform mounted under a work surface. A movable section of the work surface at a front edge thereof is removable from the work surface and movable in a path that extends downwardly and under the front edge of the keyboard tray and then rearwardly under the keyboard tray, where the movable section can be stored or removed from the desk unit. When the movable section is repositioned under the keyboard tray, the keyboard can be used or extended for use.

The desk construction of the present invention can be employed advantageously in a corer mounted desk, wherein the keyboard tray is mounted underneath an L-shaped or V-shaped corner in the desk at a 45° angle with respect to the corner. Alternatively, the invention can be employed in a conventional desk having a straight front edge of the work surface.

The invention makes it possible to provide a pull-out keyboard tray in a desk unit having an apron that extends downwardly from the underside of the work surface adjacent the front edge.

DETAILED DESCRIPTION OF PREFERRED EMBODIMENTS

Figure 1:
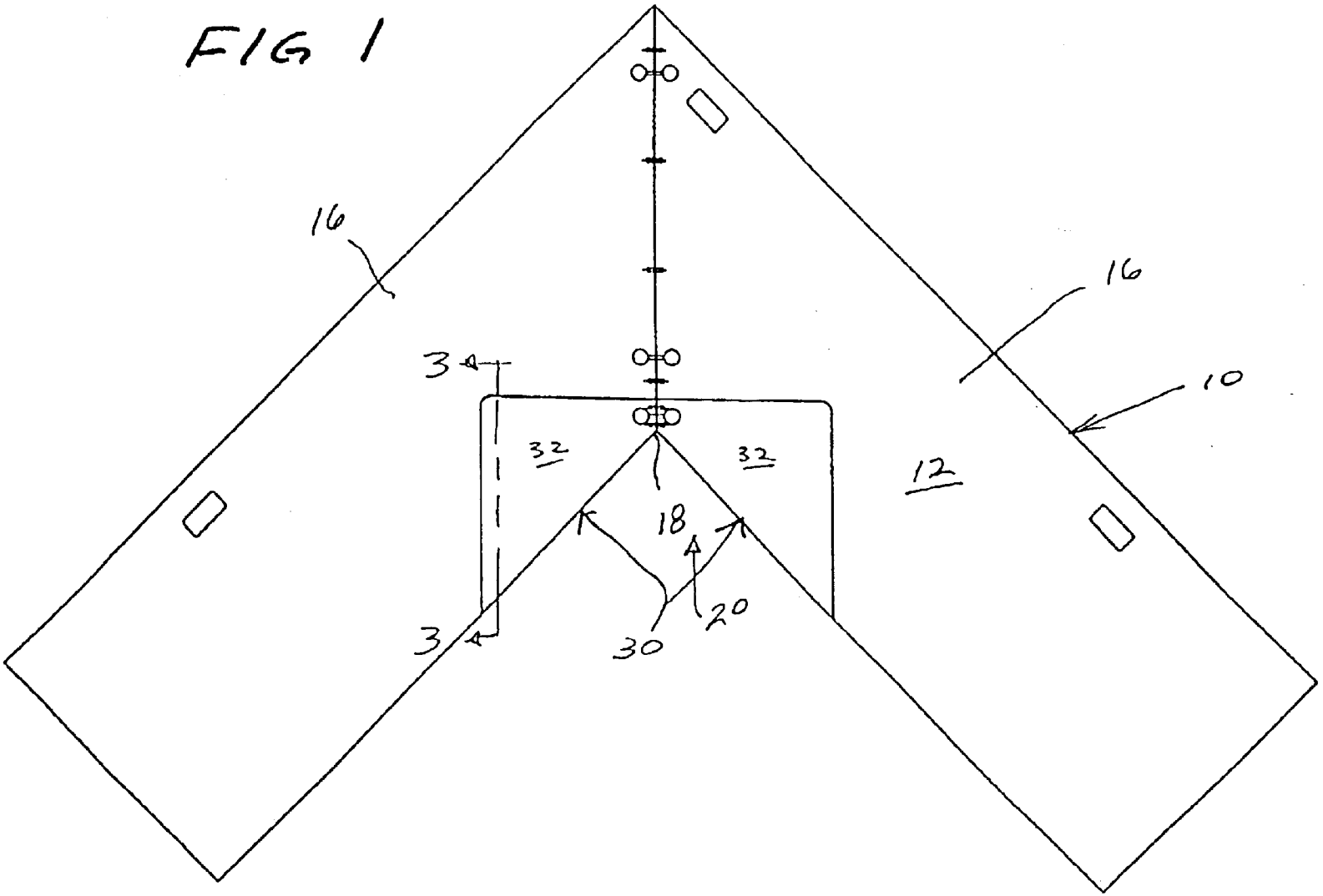
FIG. 1 is a plan view of a V-shaped corner desk employing the keyboard well of the present invention.
Figure 2:
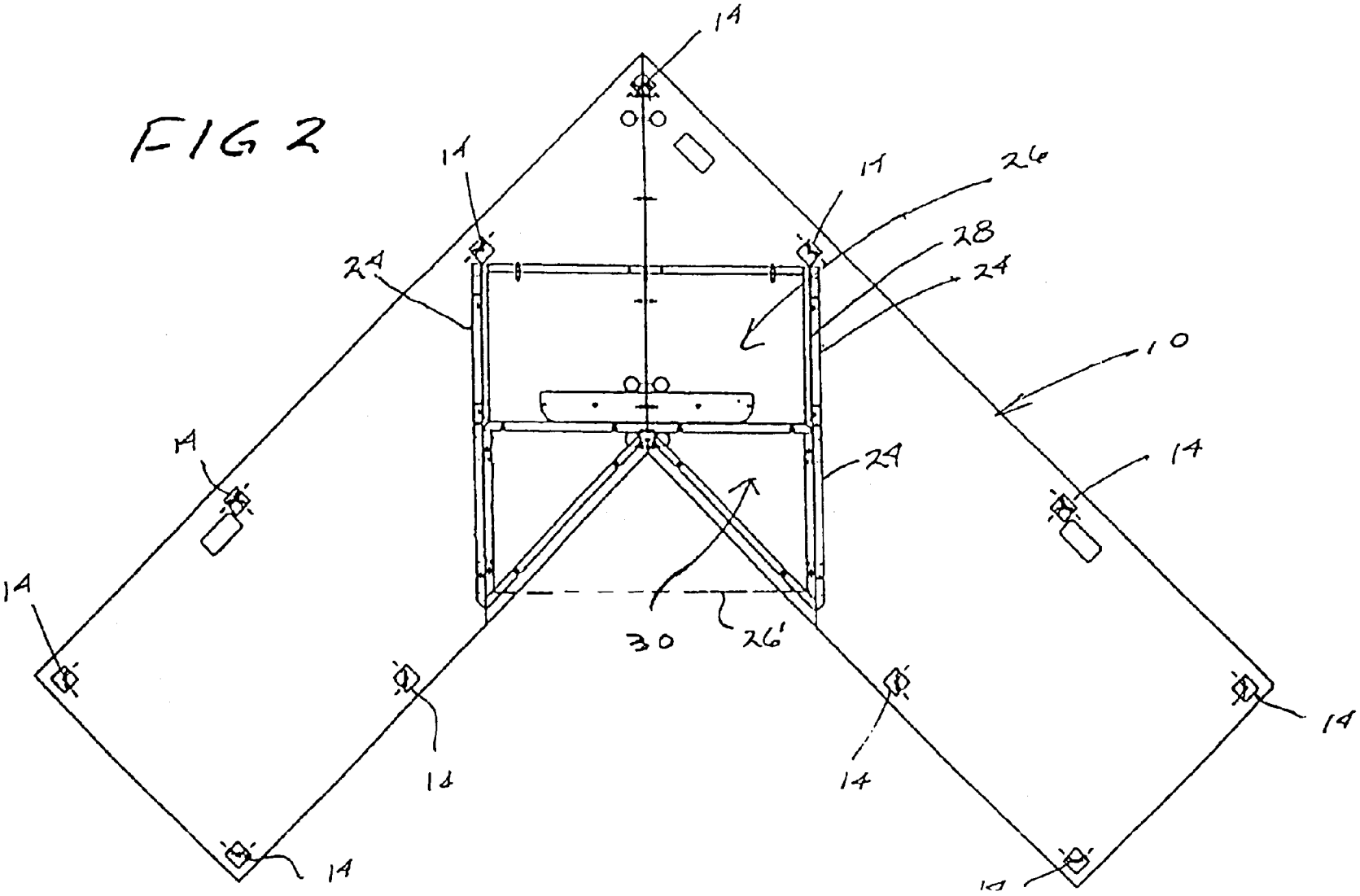
FIG. 2 is a plan view as in FIG. 1 with the work surface and keyboard well cover removed.

Referring now to the drawings, an L or V-shaped desk 10, shown in FIGS. 1 and 2, comprises a work surface 12 and work surface supports 14 that position the work surface at a working elevation. Work surface supports can comprise conventional pedestals, legs, or panels or the work surface support can be provided by a cantilevered support from a panel mechanism. The term desk is employed in the present application to refer to a work surface supported at a working elevation by any support mechanism.

Desk 10 comprises a pair of right angle sections 16 which are joined together at a 45° angle so as to form an inside corner 18 where the sections are joined. Corner 18 is formed in a front edge or front side 20 of the work surface.

Desk 10 incorporates a concealed keyboard well 22 mounted at a 45° angle in front edge 20 of the work surface. Well 22 includes a pair of spaced side members 24 attached to and extending downwardly from the underside of work surface 12 on opposite sides of corner 18, with sides 18 being positioned at a 45° angle with respect to the linear direction of sections 16. The keyboard platform 26 is positioned below the work surface and slidably mounted by slide brackets 28 between side panels 24. The keyboard platform can be moved between a stored position shown in FIG. 2 to a use position 26' shown in phantom in FIG. 2. The keyboard platform is positioned at a desired elevation for keyboard operation.

Figure 3:
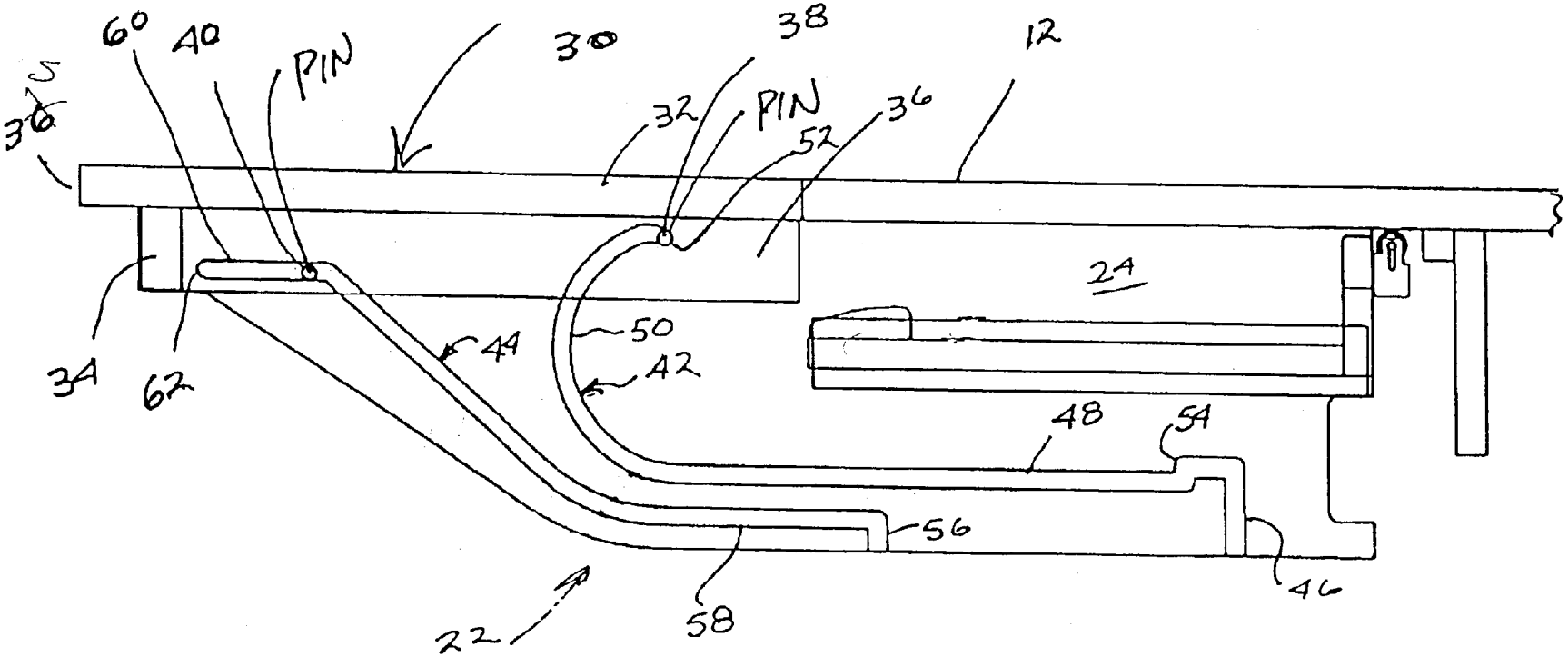
FIG. 3 is a side elevational view taken along lines 3—3 of FIG. 1, showing the movable section of the work surface that constitutes the keyboard well cover in its extended position.

The recessed keyboard platform is concealed from view by a well cover 30 that includes a movable section 32 of the work surface at the front edge of the work surface at corner 18. Movable section 32 is mounted on tracks positioned on the inside surfaces of side members 24 for movement between an extended position, shown in FIG. 3 to a retracted position shown in FIG. 7. As shown in FIGS. 1 and 3, when the well cover or removable section 32 is in its extended position, the movable section constitutes an uninterrupted portion of the writing surface of the work surface and is basically coplanar with the work surface. When moved to its retracted position, the movable section moves downwardly and rearwardly from its extended position to a stored position underneath the keyboard platform.

Referring to FIG. 3, well cover 30 not only includes movable section 32 of the work surface but it also can include a downwardly extending apron or flange 34 adjacent a front edge 35 of movable section 32. The apron is decorative (or it could be a drawer) and also serves to conceal the keyboard platform. Side panels 36 also extend downwardly from the sides of the well cover. Pins or projections 38 and 40 extend outwardly from the sides of panels 36 at spaced longitudinal locations on the panels. Pins 38 and 40 engage slots 42 and 44 on the inside surfaces of side members 24. While pins and slots provide an effective means for supporting and guiding the well cover between its extended and retracted positions, other types of track and follower mechanisms could be employed instead of a pin and slot configuration, and other movable support mechanisms can be employed for the same purpose.

As shown in FIG. 2, track slot 42 has an upwardly extending rear leg 46, a forwardly extending segment 48, and then an arcuate portion 50 extending upwardly and then rearwardly from a front end of segment 48. A distal end 52 extends slightly downwardly so that when pin 38 is nested at the end of the arcuate section, the weight of the well cover will tend to maintain it in that position. Slot 44 includes an offset portion 54 adjacent a rear end thereof where the forwardly extending segment extends upwardly and then rearwardly immediately in front of rear leg 46.

Slot 44 includes an upward leg 56 that joins an intermediate leg 58 that extends forwardly and then curves upwardly along an inclined path to a horizontally oriented upper section 60. Upper section 60 terminates at end 62 behind front apron 34.

As shown in FIG. 1, pins 38 and 40 are spaced apart so that pin 38 can ride in slot 42 and pin 40 can ride in slot 44.

When the well cover is in its extended position, which is shown in FIG. 3, pins 38 rest on downwardly and rearwardly extending distal end 52 of slot 42, while pin 40 rests on horizontal section 60 of the slot. The slots thus provide vertical support for both the front and rear sides of the movable section 32 when the well cover is in its extended position. Movable section 32 is coplanar with work surface 12 and thus serves as a portion of the work surface when in its extended position.

Figure 4:
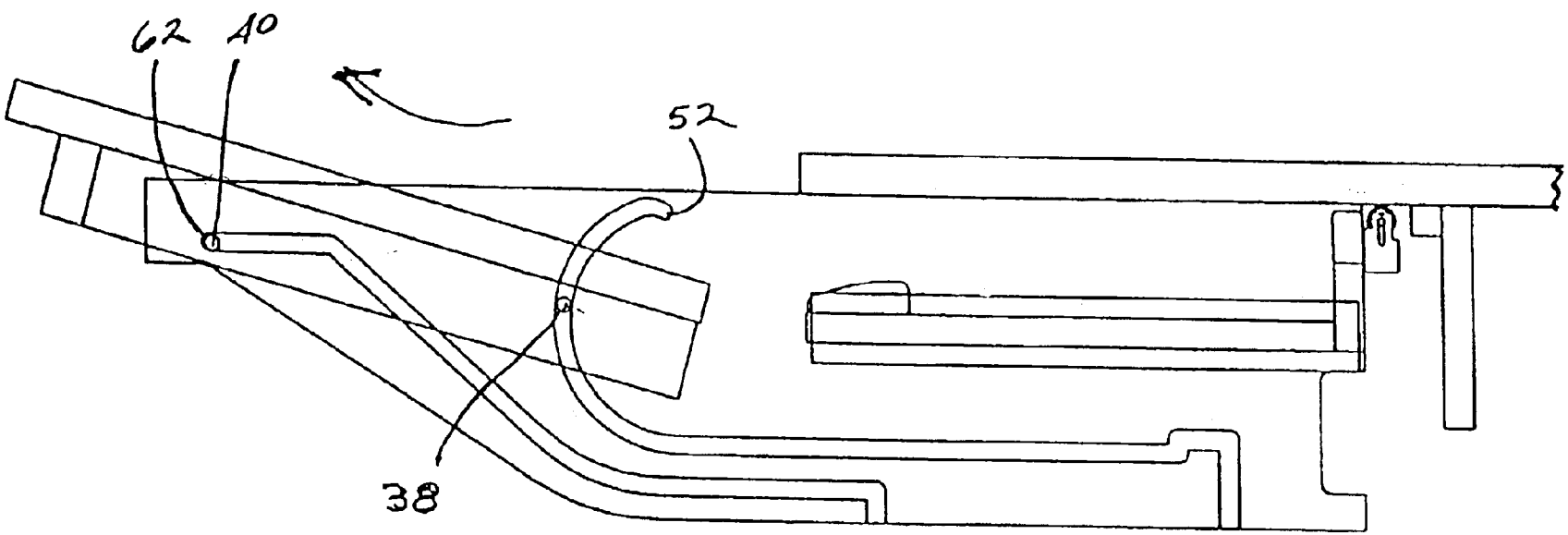
FIG. 4 is a view similar to FIG. 3 showing the initial movement of the keyboard well cover from its extended toward its retracted position.
Figure 5:
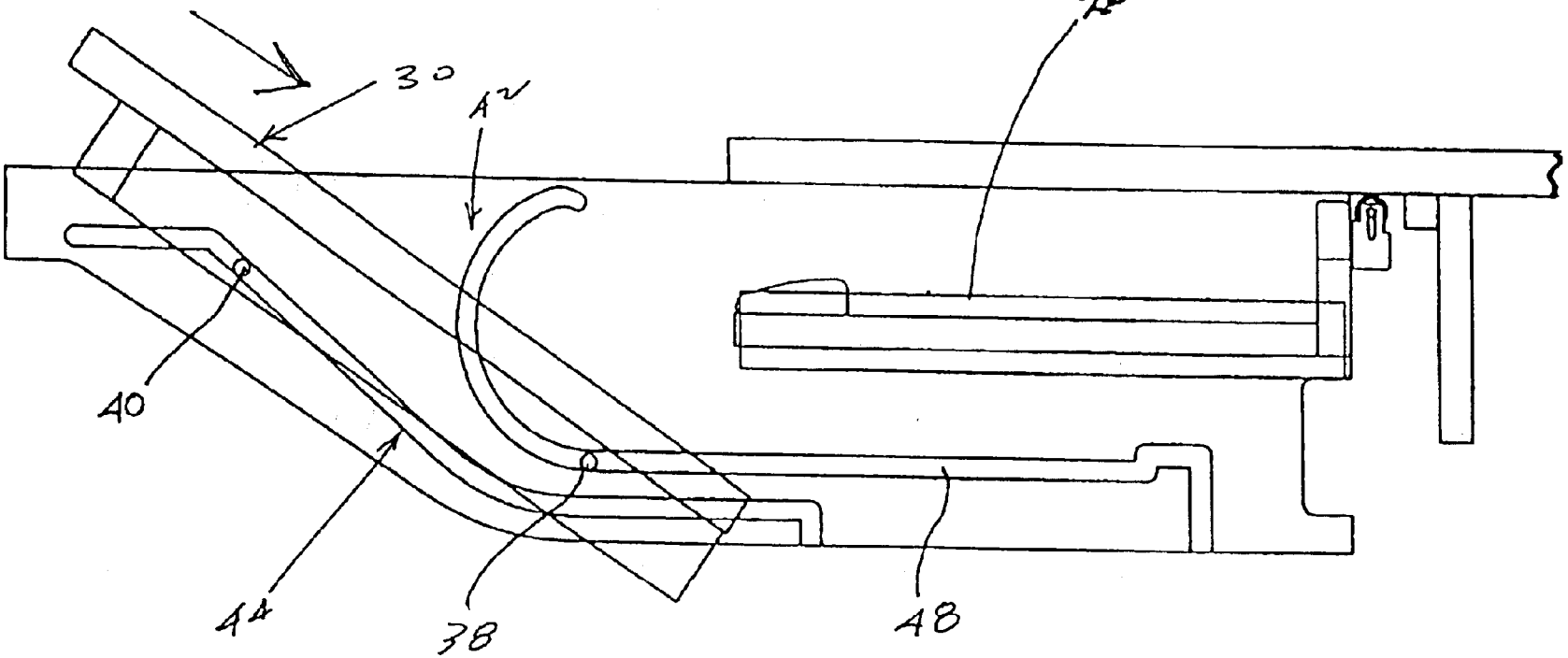
FIG. 5 is a view similar to FIG. 4 showing the well cover moved further toward its retracted position.

Referring sequentially to FIGS. 4–7, the movement of the well cover in moving from its extended position to its retracted position is shown. As shown in FIG. 4, to initiate movement of the well cover toward its retracted position, the well cover is first pulled forwardly so that pin 40 extends to the forward end 62 of slot section 60. When this is done, pin 38 first moves upwardly away from end 52 and then follows a downward arcuate path along arcuate section 50. Thus, the well cover moves forwardly and then tips rearwardly in its initial movement from its extended to its retracted position, as shown in FIG. 4. As shown in FIG. 5, the well cover is then pushed rearwardly where the pins continue to follow the slots. In FIG. 5, pin 40 is engaging the inclined portion of the intermediate leg of slot 44 while pin 38 has reached the bottom of arcuate portion 50 and has commenced horizontal movement along segment 48. Thus, the rear edge of the cover has reached a position below keyboard platform 26 while the front side of the well cover continues to drop downwardly.

Figure 6:
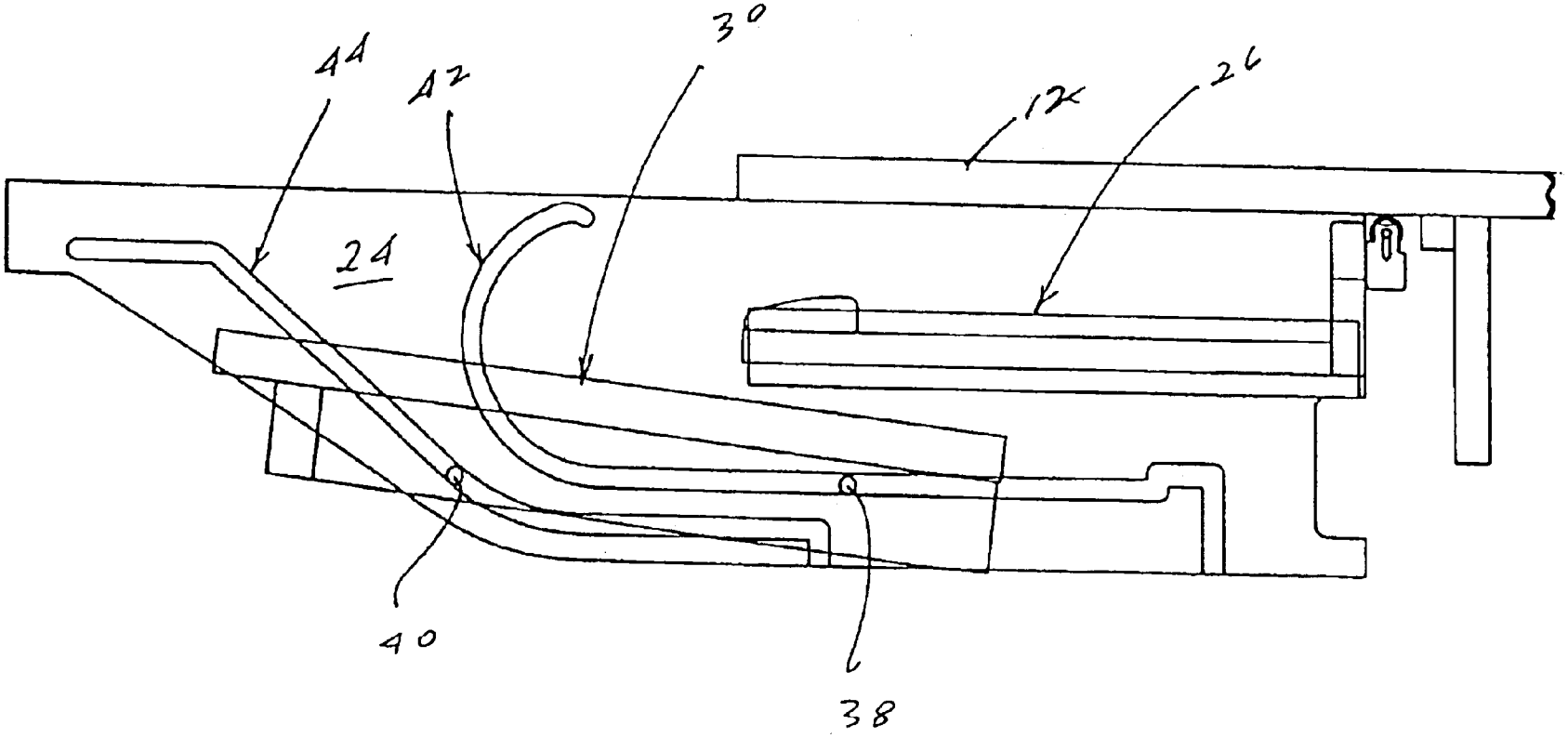
FIG. 6 is a view similar to FIG. 5 showing the well cover moved further toward its retraced position.

Referring to FIG. 6, it can be seen that as the well cover traverses in a rearward direction, the entire well cover recedes to a position below the level of keyboard platform 26. A shown in FIG. 7, the path continues until the well cover is completely below keyboard platform 26. At this point, pin 38 engages offset portion 54 in slot 42, and the offset portion stops the cover from further movement rearwardly. The well cover is thus in its retracted or stored position and is completely out of the way from the keyboard platform.

Figure 7:
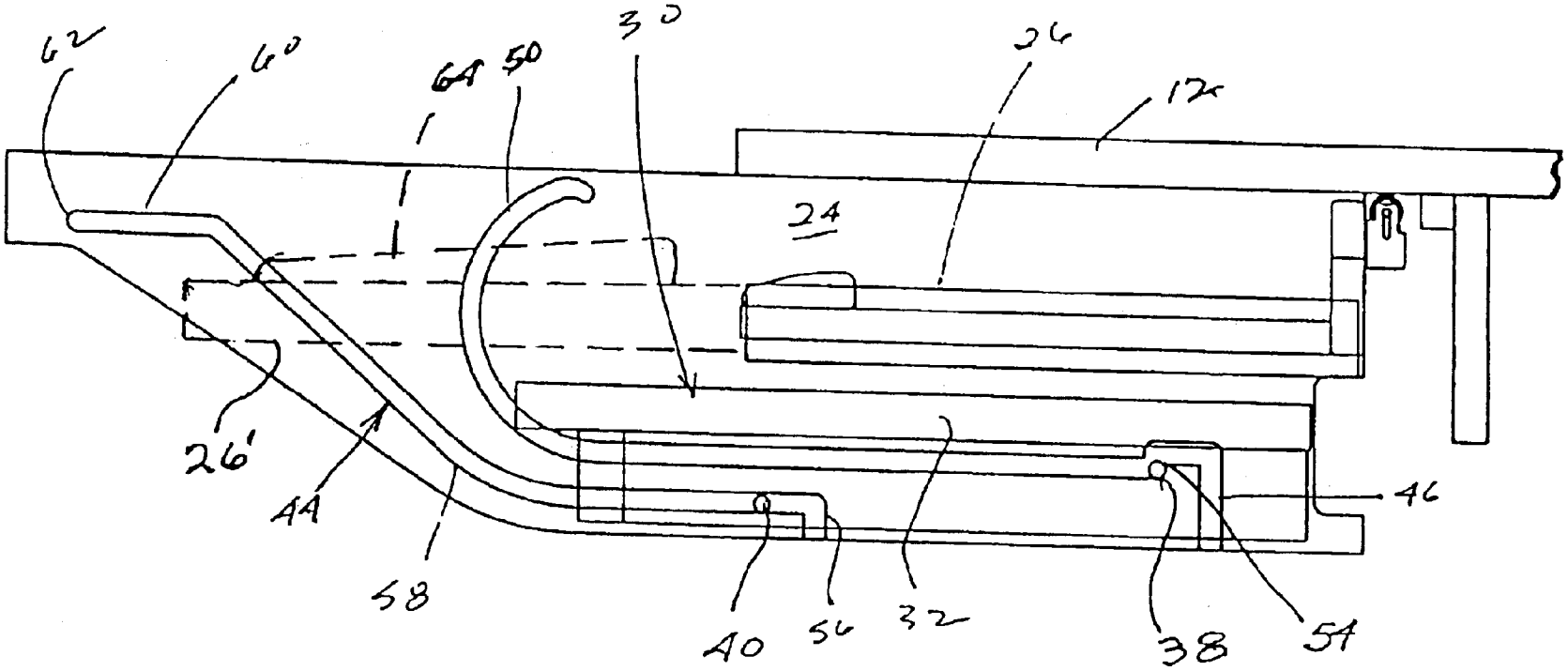
FIG. 7 is a view similar to FIG. 5 showing the well cover moved completely to its retracted position.

Keyboard platform 26 can then be extended to the position of platform 26', as shown in phantom in FIGS. 1 and 7. In this position, a keyboard 64 (shown schematically in phantom) is positioned for convenient access at the corner of the desk.

Figure 8:
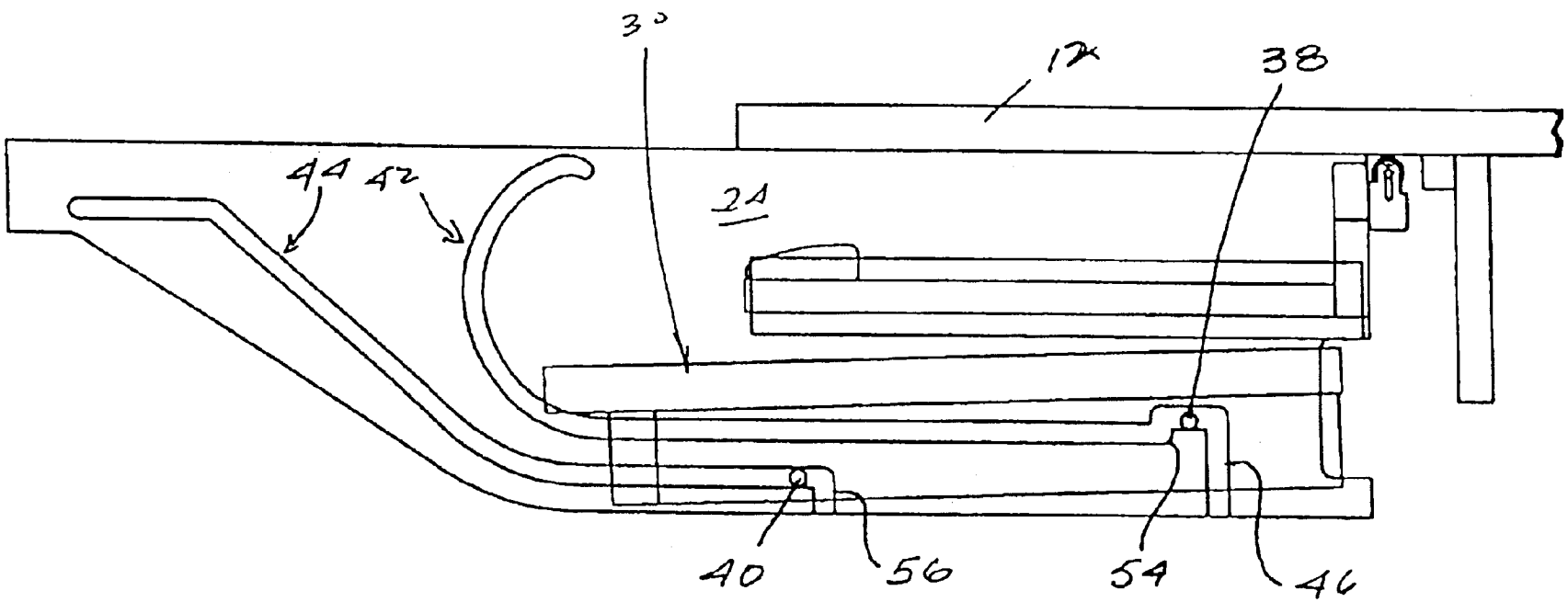
FIG. 8 is a view similar to FIG. 7 showing the well cover being moved to a position where it can be removed from the desk unit entirely.
Figure 9:
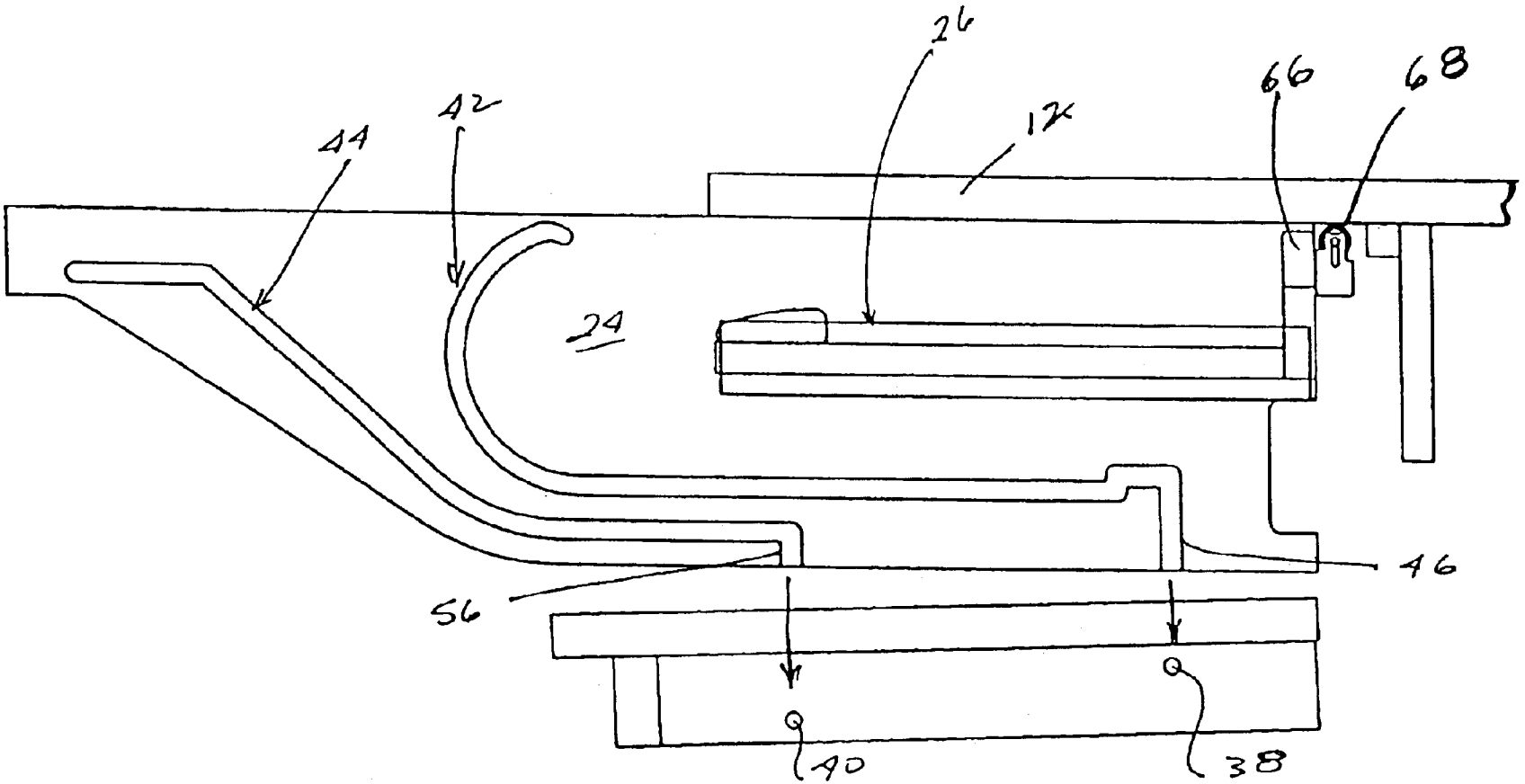
FIG. 9 is a view similar to FIG. 8 wherein the well cover is removed completely from the desk unit.

If it is desired to remove the well cover completely from the apparatus (for disassembly or for additional knee room), the rear end of the well cover can be lifted upwardly so that pin 38 is lifted over the stop provided by offset portion 54, as shown in FIG. 8. Then, the pins can proceed rearwardly to downward legs 46 and 56. The well cover is then lowered out of the track formed by the slots and removed from the apparatus, as shown in FIG. 9. Reinsertion of the well cover can be accomplished in a reverse direction.

The keyboard platform desirably is extendable, as shown in FIGS. 1 and 7. The keyboard platform can be mounted with conventional hardware on the inside surfaces of the side members that permits the keyboard platform to slide or roll on a horizontal track in a forward and rearward direction. The keyboard platform may have an upwardly extending rear panel 66, and a roller 68 can be mounted at the upper end of the rear panel in order to ride along the underside of the work surface so as to maintain the keyboard platform in a horizontal position and provide a non-friction rolling contact between the rear end of the keyboard platform and the underside of the work surface.

Figure 10:
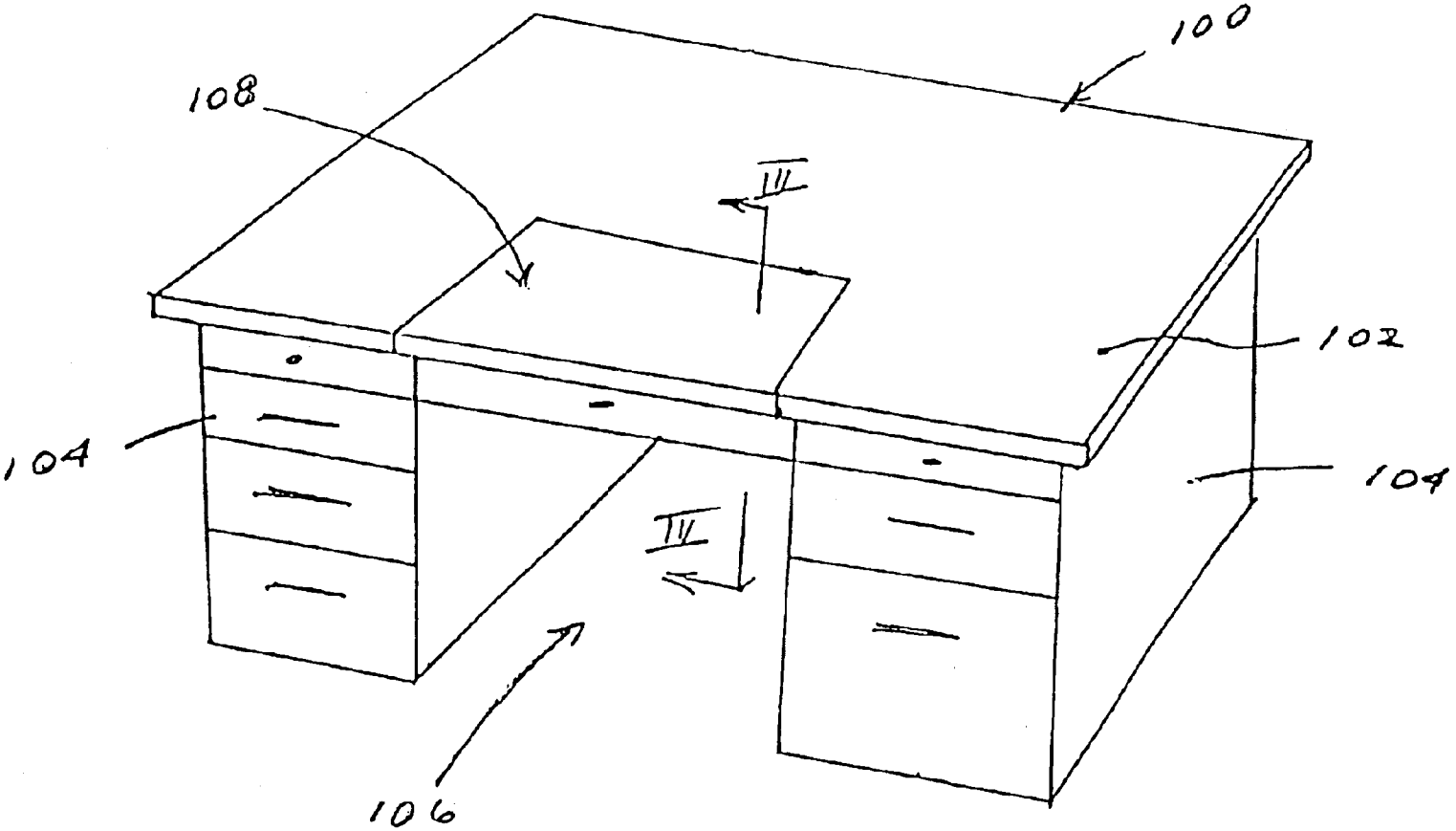
FIG. 10 is a perspective view of a conventional desk employing the keyboard well of the present invention.
Figure 11:
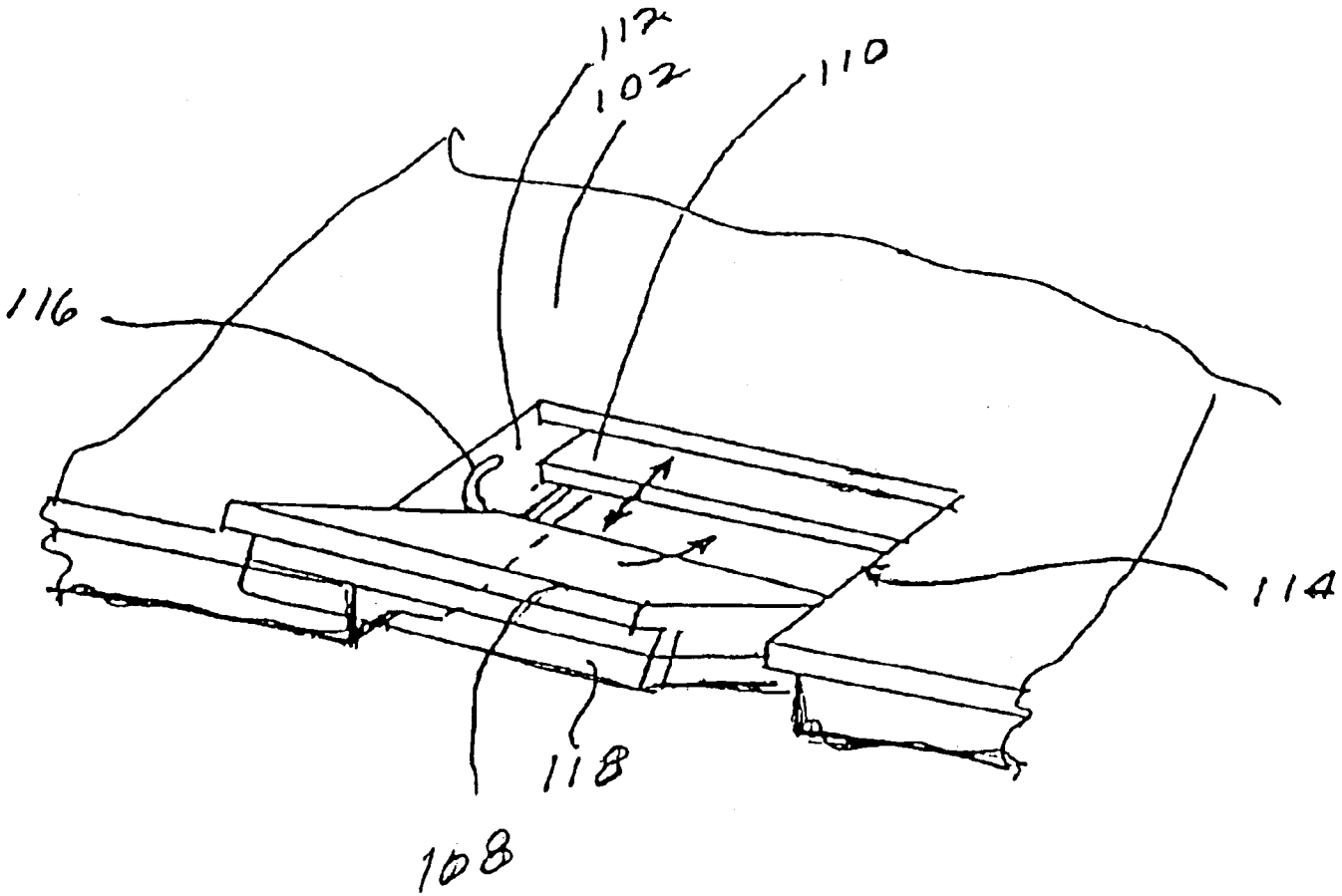
FIG. 11 is a fragmentary view of the desk of FIG. 10 showing the well cover partially moved from its extended to its retracted positions.

While the present invention is desirably employed in connection with a V-shaped desk wherein separate sections are mounted at a skewed angle to form a corner, the present invention can also be employed with a conventional desk having a straight front edge, as shown in FIGS. 10 and 11. In FIG. 10, a desk 100 includes a work surface 102 and pedestal supports 104 on each side of opening 106 between the pedestals. A keyboard well cover 108 is shown in its extended position in FIG. 10. The well cover can be mounted on tracks positioned on side members at the sides of the well cover or on the inside surfaces of pedestals 104, in the same manner as the V-shaped desk described above.

Referring to FIG. 11, well cover 108 is shown partially moved between its extended and retracted positions. A keyboard platform 110 is shown mounted under work surface 102. Side members 112 on opposite sides of the opening 114 formed where the well cover fits into the work surface include slots 116 that engage pins in the sides of the cover in the manner described above. Because the cover fits under the keyboard platform, an apron 118 extending downwardly from the front edge of the cover can be used to conceal the keyboard platform and yet will not impede the movement of the keyboard platform to its use position.

The concealed keyboard well can be incorporated into a corner desk unit of modular furniture employing any number of separate modular components.

It should be understood that the foregoing is merely exemplary of the preferred practice of the present invention and that various changes and modifications may be made in the arrangements and details of construction of the embodiments disclosed herein without departing from the spirit and scope of the present invention.

We claim:

1. A desk having a concealed keyboard well, comprising:

an elevated work surface having a fixed section and a movable section, the movable section comprising a flat panel movably mounted in the desk or movement between an extended position, wherein the movable section is in a forward, raised position and is substantially coplanar with the fixed section and forms a front portion of the work surface, and a retracted position, wherein the movable section is in a lowered and rearward position relative to the extended position; and a keyboard platform mounted in the desk at an elevation between the raised and lowered positions of the movable section, the keyboard platform being concealed by the movable section when the movable section is in its extended position, the keyboard platform being positioned above the movable section and being accessible for keyboard access when the movable section is in its retracted position, the movable section being mounted for movement in front of the keyboard platform in moving between its extended and retracted positions, the keyboard platform being movably mounted for generally forward movement from a stored position to a use position when the movable section of the work surface is in its retracted position, the stored position being rearward of the use position.

2. A desk as in claim 1 wherein the moveable section includes an apron that extends downwardly from the movable section adjacent a front edge thereof, the apron being movable along with the movable section in moving between its extended and retracted position, the apron moving below the elevation of the keyboard platform when the movable section is in it refracted position.

3. A desk as in claim 1 wherein the desk is a corner desk having a V-shaped front edge, the keyboard platform being mounted so as to be facing outwardly in a direction between sides of the V-shaped front edge.

4. A desk having a concealed keyboard well, comprising:

an elevated work surface having a fixed section and a movable section, the movable section comprising a flat panel movably mounted in the desk for movement between an extended position, wherein the movable section is in a forward, raised position and is substantially coplanar with the fixed section and forms a front portion of the work surface, and a retracted position, wherein the movable section is in a lowered and rearward position relative to the extended position; and a keyboard platform mounted in the desk at an elevation between the raised and lowered positions of the movable section, the keyboard platform being concealed by the movable section when the movable section is in its extended position, the keyboard platform being positioned above the movable section and being accessible for keyboard access when the movable section is in its retracted position, the movable section being mounted for movement in front of the keyboard platform in moving between its extended and retracted positions, the movable section being mounted in a track that causes the movable section to first move forwardly and then downwardly and then rearwardly in moving from its extended to its retracted position.

5. A desk as in claim 4 wherein the movable section is mounted in two tracks, a front track guiding a front portion of the movable section and a rear track guiding a rear portion of the movable section, the tracks being formed such that, in moving from its extended to its retracted positions, the movable section first moves forwardly, then the rear of the movable section tips downwardly under the level of the keyboard platform, then the rear of the movable section slides rearwardly and the front of the movable section moves downwardly and rearwardly, the movable section moving rearwardly to its retracted position wherein it does not interfere with the use of a keyboard mounted on the keyboard platform when the keyboard platform is in a use position.

6. A desk as in claim 5 wherein the tracks are on downwardly extending side panels positioned adjacent side edges of the movable section, track followers being positioned at the side edges of the movable section, the tracks and track followers fitting together to provide a guide path for movable section in moving between the extended and retracted positions.

7. A desk as in claim 5 wherein the tracks comprise slots in the side panels and the track followers comprise pins extending out of the sides of the movable section, the pins fitting in the slots and being guided thereby.

8. A desk as in claim 5 wherein the tracks have outlet portions that permit a user to completely remove the moveable section from the tracks and the desk.

* * * * *

UNITED STATES PATENT AND TRADEMARK OFFICE

CERTIFICATE OF CORRECTION

PATENT NO. : 6,846,052 B2
DATED : January 25, 2005
INVENTOR(S) : James O. Kelley et al.

It is certified that error appears in the above-identified patent and that said Letters Patent is hereby corrected as shown below:

Title page,
Item [74], *Attorney, Agent or Firm*, "Schmdt." should be -- Schmidt --

Column 2,
Line 5, "corer" should be -- corner --.

Column 3,
Line 17, "removeable" should be -- movable --.

Column 4,
Line 21, "A" should be -- As --.

Column 5,
Line 23, "or" should be -- for --.
Line 51, "it" should be -- its -- and "refracted" should be -- retracted --.

Signed and Sealed this

Third Day of May, 2005

JON W. DUDAS
*Director of the United States Patent and Trademark Office*